US012702263B2

(12) United States Patent
Liu et al.

(10) Patent No.: US 12,702,263 B2
(45) Date of Patent: Aug. 11, 2026

(54) CLEANING APPARATUS

(71) Applicant: Beijing Roborock Technology Co., Ltd., Beijing (CN)

(72) Inventors: Xiaoyu Liu, Beijing (CN); Yongliang Shang, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 287 days.

(21) Appl. No.: 18/287,460

(22) PCT Filed: Mar. 22, 2022

(86) PCT No.: PCT/CN2022/082318
§ 371 (c)(1),
(2) Date: Oct. 18, 2023

(87) PCT Pub. No.: WO2022/222670
PCT Pub. Date: Oct. 27, 2022

(65) Prior Publication Data

US 2026/0114695 A1 Apr. 30, 2026

(30) Foreign Application Priority Data

Apr. 19, 2021 (CN) ..... 202110419996.X

(51) Int. Cl.
*A47L 11/40* (2006.01)
*A47L 11/30* (2006.01)

(52) U.S. Cl.
CPC ..... *A47L 11/4069* (2013.01); *A47L 11/305* (2013.01); *A47L 11/4055* (2013.01); *A47L 2201/00* (2013.01)

(58) Field of Classification Search
CPC ..... A47L 11/40; A47L 11/4069; B08B 1/002; A46B 13/02
See application file for complete search history.

(56) References Cited

U.S. PATENT DOCUMENTS 10,507,569 B1 * 12/2019 Marotta ..... B08B 1/34
11,033,100 B1 * 6/2021 Park ..... A46B 13/001
(Continued)

FOREIGN PATENT DOCUMENTS

CN 102839623 A 12/2012
CN 106246351 A 1/2017
(Continued)

OTHER PUBLICATIONS

English Translation for Patent Publication; Jan. 2017.*
(Continued)

*Primary Examiner* — Michael D Jennings
(74) *Attorney, Agent, or Firm* — Morgan, Lewis & Bockius LLP

(57) ABSTRACT

Provided in the embodiments of the present disclosure is a cleaning apparatus, comprising: a control device for driving a rotating electric motor to rotate; and a cleaning device comprising a brush plate, a clamping mechanism, and a transmission portion that is connected to the rotating electric motor, wherein the rotating electric motor drives the transmission portion to rotate in a first direction relative to the brush plate, such that the brush plate is clamped onto the transmission portion by means of the clamping mechanism; and the rotating electric motor drives the transmission portion to rotate relative to the brush plate in a second direction opposite to the first direction so as to release the clamping of the clamping mechanism and the transmission portion, the first direction being a rotating direction of the transmission portion in a normal operating state.

19 Claims, 4 Drawing Sheets

(56) References Cited

U.S. PATENT DOCUMENTS

| | | | | |
|---|---|---|---|---|
| 11,266,227 | B1 * | 3/2022 | Manning | A46B 5/0095 |
| 2014/0196231 | A1 | 7/2014 | Park et al. | |
| 2019/0047668 | A1 * | 2/2019 | Smith | A46B 13/008 |
| 2021/0274925 | A1 * | 9/2021 | Langberg | A46B 13/008 |
| 2022/0167587 | A1 * | 6/2022 | Mogren | A01K 13/003 |
| 2022/0167736 | A1 * | 6/2022 | Yeates | A61H 7/005 |

FOREIGN PATENT DOCUMENTS

| | | | | | |
|---|---|---|---|---|---|
| CN | 106264351 | A | * | 1/2017 | A47L 11/4038 |
| CN | 206995193 | U | | 2/2018 | |
| CN | 201383781 | U | | 4/2020 | |
| CN | 210383781 | U | | 4/2020 | |
| CN | 111743467 | A | | 10/2020 | |
| CN | 112535438 | A | | 3/2021 | |
| CN | 113057543 | A | | 7/2021 | |
| CN | 215650850 | U | | 1/2022 | |
| GB | 2282318 | A | | 4/1995 | |
| JP | H06-041653 | A | | 6/1994 | |
| JP | 2010-172597 | A | | 8/2010 | |
| KR | 20-2008-0006661 | U | | 12/2008 | |
| WO | WO-2012054506 | A2 | * | 4/2012 | A46B 13/008 |
| WO | 2013110623 | A1 | | 8/2013 | |

OTHER PUBLICATIONS

Office Action issued in corresponding Chinese Patent Application No. 202110419996.X, dated Dec. 16, 2024.

International Search Report issued in corresponding International Patent Application No. PCT/CN2022/082318, mailed Jun. 6, 2023.

Extended European Search Report issued in corresponding European Patent Application No. 22790779.7, dated Sep. 30, 2025.

* cited by examiner

CLEANING APPARATUS

CROSS-REFERENCE TO RELATED APPLICATION

This application is a U.S. National Stage of International Application No. PCT/CN2022/082318, filed on Mar. 22, 2022, which claims priority of the Chinese Patent Application No. 202110419996.X, filed on Apr. 19, 2021, which is incorporated herein by reference in its entirety as a part of the present application.

TECHNICAL FIELD

The present disclosure relates to the field of cleaning devices, and in particular, to a cleaning device.

BACKGROUND ART

With the development of social productive forces, mechanization and automation have gradually replaced the heavy manual labor of human beings. For traditional ground washing and mopping, tools such as mops are usually used. As a result, the working efficiency is low and the ground is not easy to dry. In order to solve the above problems, self-moving cleaning devices emerge as the times require.

As a main component of the cleaning device, a brush disc usually cleans the ground by rotating. Therefore, bristles on the brush disc are seriously worn after use for a long time, which affects the cleaning effect. Therefore, it is necessary to replace or maintain the brush disc regularly. However, the existing brush discs are fixedly connected by bolts, and the brush discs are relatively heavy and larger in size, and thus are inconvenient to dismount and mount.

SUMMARY OF THE INVENTION

In this section, a series of concepts in a simplified form are introduced, which will be further explained in detail in the Detailed Description section. This section is neither intended to try to define the key features and essential technical features of the claimed technical solution, nor is it intended to try to determine the protection scope of the claimed technical solution.

Embodiments of the present disclosure provide a cleaning device, including:

a control apparatus for controlling a rotating motor to rotate; and a cleaning apparatus, including a brush disc, an engagement mechanism and a transmission portion connected with the rotating motor, wherein the rotating motor drives the transmission portion to rotate in a first direction relative to the brush disc, so that the brush disc is engaged with the transmission portion through the engagement mechanism; the rotating motor drives the transmission portion to rotate in a second direction opposite to the first direction relative to the brush disc, so that the engagement mechanism is disengaged from the transmission portion, and the first direction is a rotating direction of the transmission portion in a normal working state.

Optionally, the cleaning device further includes a lifting and lowering mechanism, wherein the lifting and lowering mechanism is used for driving the transmission portion to lift or lower; and the lifting and lowering mechanism and the rotating motor cooperate with each other to realize engagement or disengagement of the engagement mechanism and the transmission portion.

Optionally, the rotating motor drives the transmission portion to rotate in the first direction in a process in which the lifting and lowering mechanism drives the transmission portion to lower, and after the lifting and lowering mechanism drives the transmission portion to lower in place, the rotating motor drives the transmission portion to rotate in the first direction relative to the brush disc with a first maximum stroke, so that the engagement mechanism is engaged with the transmission portion; the first maximum stroke is a rotation stroke that the rotating motor rotates in the first direction to engage the engagement mechanism with the transmission portion;

or after the lifting and lowering mechanism drives the transmission portion to lower in place, the rotating motor drives the transmission portion to rotate in the first direction relative to the brush disc with a first maximum stroke, so that the engagement mechanism is engaged with the transmission portion.

Optionally, the rotating motor drives the transmission portion to rotate in the second direction in a process in which the lifting and lowering mechanism drives the transmission portion to lower, and after the lifting and lowering mechanism drives the transmission portion to lower in place, the rotating motor drives the transmission portion to rotate in the second direction relative to the brush disc with a second maximum stroke, so that the engagement mechanism is disengaged from the transmission portion; the second maximum stroke is a rotation stroke that the rotating motor rotates in the second direction to disengage the engagement mechanism from the transmission portion;

or after the lifting and lowering mechanism drives the transmission portion to lower in place, the rotating motor drives the transmission portion to rotate in the second direction relative to the brush disc with a second maximum stroke, so that the engagement mechanism is disengaged from the transmission portion.

Optionally, the number of the cleaning apparatuses is two, and the rotating directions of the transmission portions of the two cleaning apparatuses are opposite in a normal working state.

Optionally, after the brush disc is engaged with the transmission portion, all engagement portions and all position-limiting portions are located on the same circumference.

Optionally, each engagement portion includes an engagement body, and the engagement body is connected with an outer edge of the transmission portion and extends towards a direction away from the transmission portion; the engagement body is provided with a clamping groove at least in a side opposite to the corresponding position-limiting portion, and each position-limiting portion includes a position-limiting pin connected with the brush disc; and when the transmission portion drives the engagement bodies to rotate to engagement positions, the clamping groove of each engagement body is engaged with the corresponding position-limiting pin; and when the transmission portion drives the engagement bodies to rotate to the disengagement positions, the clamping groove of each engagement body is disengaged from the corresponding position-limiting pin.

Optionally, each engagement body is provided with a first clamping groove in a first side and a second clamping groove in a second side, and the second side is a side of the engagement body opposite to the first side; the engagement positions include a first engagement position and a second engagement position;

when the transmission portion drives the engagement bodies to rotate to the first engagement positions, the first clamping groove of each engagement body is engaged with the adjacent position-limiting pin; when the transmission portion drives the engagement bodies to rotate to the second engagement positions, the second clamping groove of each engagement body is engaged with the corresponding position-limiting pin; when the transmission portion drives the engagement bodies to rotate to the disengagement positions, the first clamping groove of each engagement body is in contact and is engaged with the adjacent position-limiting pin, and the second clamping groove of each engagement body is in contact and is engaged with the adjacent position-limiting pin.

Optionally, at least one engagement portion is provided with a corresponding stop portion, and the stop portion is used for preventing the first clamping groove or the second clamping groove from being engaged with the adjacent position-limiting portion.

Optionally, the stop portion is disposed at a position on the edge of the transmission portion corresponding to the first clamping groove or the second clamping groove, and the stop portion is used for preventing the first clamping groove or the second clamping groove from being engaged with the adjacent position-limiting portion.

Optionally, the stop portion is mounted at a position on the edge of the transmission portion corresponding to the first clamping groove or the second clamping groove, and the stop portion is adjacent to the edge of the first clamping groove or the second clamping groove close to the transmission portion.

Optionally, the stop portion is detachably connected with the edge of the transmission portion.

Optionally, at least one engagement portion is provided with a corresponding locking portion, and the locking portion is used for locking with the corresponding position-limiting portion when each engagement portion is engaged with the corresponding position-limiting portion, so as to restrict the engagement portion from rotating towards the disengagement position.

Optionally, the locking portion is mounted at a position on the edge of the transmission portion corresponding to the engagement portion, and the first clamping groove or the second clamping groove is at least partially shielded by the stop portion;

the locking portion includes an elastic arm, and an end of the elastic arm close to the corresponding position-limiting portion is provided with a curved portion; and when each engagement portion is engaged with the corresponding position-limiting portion, the position-limiting portion is at least partially located in the curved portion, so as to restrict the engagement portion from rotating towards the disengagement position.

Optionally, a guiding portion is disposed at the lower part of the transmission portion, an orientating portion adapted to the guiding portion is further disposed on the brush disc, and the transmission portion is engaged with the brush disc through cooperation of the guiding portion and the orientating portion.

Optionally, the guiding portion is a protrusion extending downward from the transmission portion, and the orientating portion is a recess for accommodating the protrusion.

BRIEF DESCRIPTION OF THE DRAWINGS

The following accompanying drawings of the present disclosure, as part of the embodiments of the present invention, serve to understand the present invention. The embodiments of the present disclosure and their descriptions are shown in the accompanying drawings to explain the principles of the present disclosure.

In the accompanying drawings.

Description of reference signs in the accompanying drawings:

1—brush disc, 101—brush disc body, 102—bristles, 103—orientating portion, 2—engagement mechanism, 201—engagement portion, 2011—engagement body, 2012—clamping groove, 2013—first clamping groove, 2014—second clamping groove, 202—position-limiting portion, 2021—position-position-limiting pin, 2022—fastener, 3—transmission portion, 301—connecting shaft, 302—connector, 303—guiding portion, 4—stop portion, 5—locking portion, 501—elastic arm, 502—curved portion, 6—bolt, 7—main body, 8—fluid storage apparatus, 9—rotating motor, 10—chassis, 11—lifting and lowering mechanism, 1101—driving motor, 1102—first connecting rod, 11021—first swing arm, 11022—bent portion, 11023—second swing arm, 1103—second connecting rod, 1104—first synchronizing shaft, 1105—second synchronizing shaft, 1106—third synchronizing shaft, 1107—mounting base, 1108—position-limiting portion, 1109—connector, and 12—packaging housing.

DETAILED DESCRIPTION

In the following descriptions, numerous specific details are given in order to provide more thorough understanding of the present disclosure. However, it is apparent to those skilled in the art that the present disclosure can be implemented without one or more of these details. In other instances, in order to avoid confusion with the present disclosure, some technical features well known in the art have not been described.

It should be noted that the terminology used here is only for describing specific embodiments and is not intended to limit exemplary embodiments according to the present disclosure. As used herein, the singular form is also intended to include the plural form unless the context clearly indicates otherwise. Furthermore, it should also be understood that when the terms “include” and/or “comprise” are used in the description, they specify the presence of said features, integers, steps, operations, elements and/or assemblies, but do not exclude the presence or addition of one or more other features, integers, steps, operations, elements, assemblies and/or combinations thereof.

Now, the exemplary embodiments according to the present disclosure will be described in more detail with reference to the accompanying drawings. However, these exemplary embodiments can be implemented in many different forms and should not be construed as being limited to the embodiments set forth herein. It should be understood that these embodiments are provided to make the technical solutions involved in the present disclosure complete, and fully convey the concepts of these exemplary embodiments to those ordinary skilled in the art.

Figure 1:
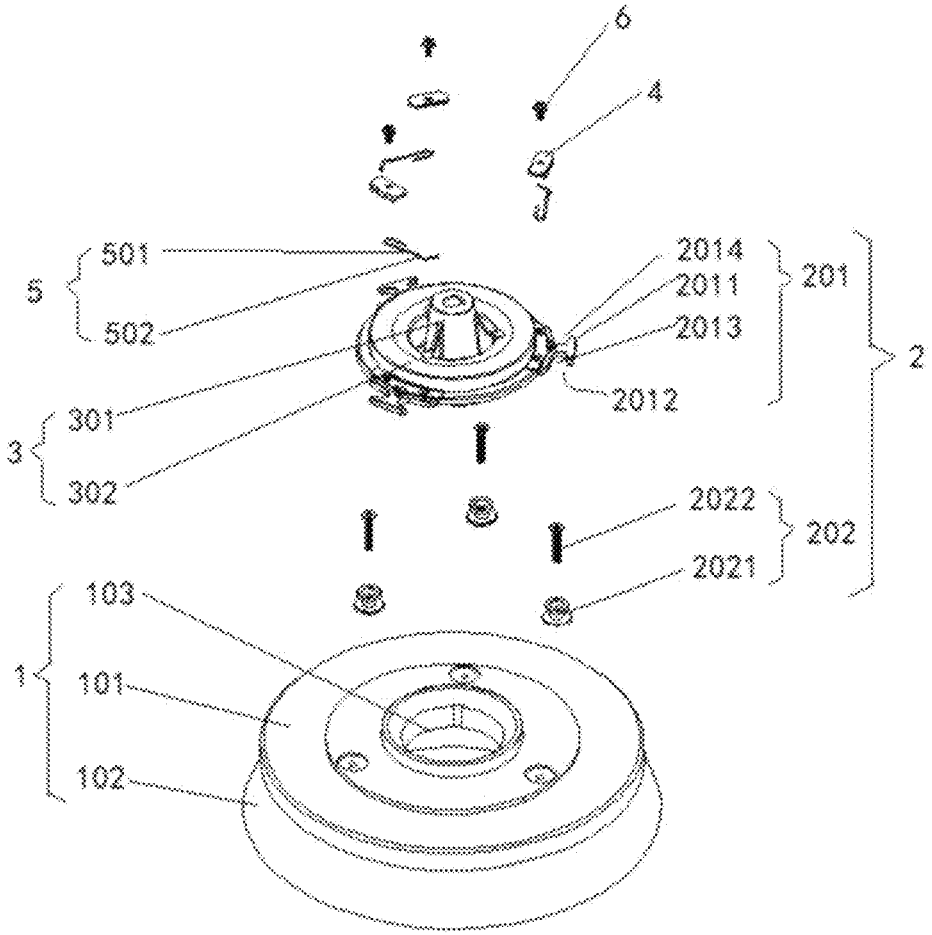
FIG. 1 is an exploded view of a cleaning apparatus according to an optional embodiment of the present disclosure.
Figure 4:
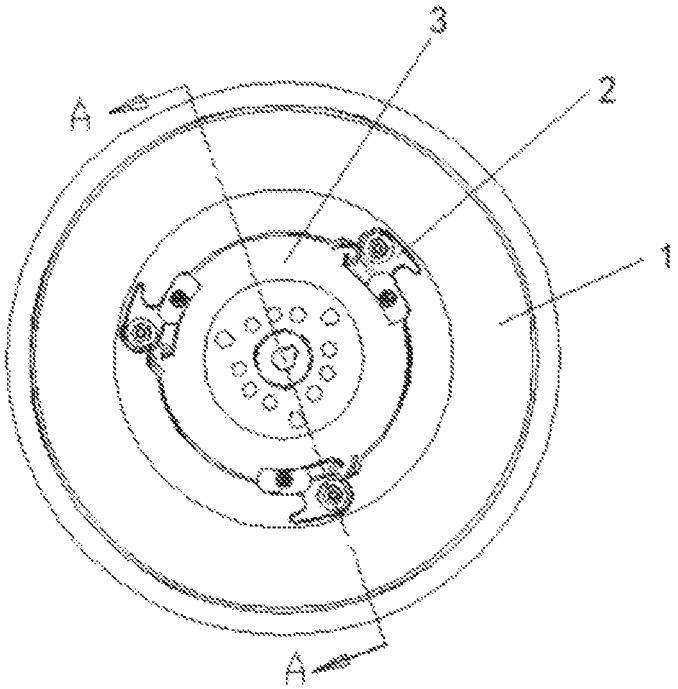
FIG. 4 is a top view of FIG. 1.
Figure 5:
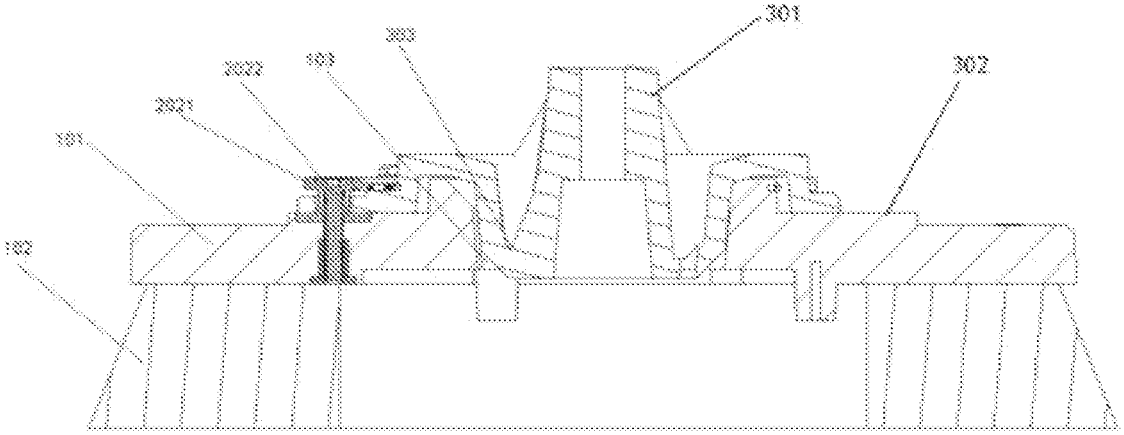
FIG. 5 is a sectional view of FIG. 4 in direction A-A.

As shown in FIG. 1, FIG. 4 and FIG. 5, the embodiments of the present disclosure provide a cleaning device, which includes a controller 32 for controlling a rotating motor 9 to rotate; and a cleaning apparatus including a brush disc 1, an engagement mechanism 2 and a transmission portion 3 connected with the rotating motor 9. The rotating motor 9 drives the transmission portion 3 to rotate in a first direction relative to the brush disc 1, so that the brush disc 1 is engaged with the transmission portion 3 through the engagement mechanism 2. The rotating motor 9 drives the transmission portion 3 to rotate in a second direction opposite to the first direction relative to the brush disc 1, so that the engagement mechanism 2 is disengaged from the transmission portion 3. The first direction is a rotating direction of the transmission portion 3 in a normal working state.

The automatic cleaning device according to one embodiment of the present disclosure is a device that can automatically travel in an area to be cleaned and automatically perform a cleaning operation. The automatic cleaning device may include, but is not limited to, an automatic floor washing machine, an automatic floor sweeping machine, an automatic mopping-sweeping integrated machine, etc. The automatic cleaning device may also include structures such as a fluid storage apparatus 8, a walking apparatus, a spraying apparatus and a sewage recovery apparatus.

The fluid storage apparatus 8 may be integrally molded from a material such as plastic, and may be used as a housing of a main body 7, so as to improve the elasticity, toughness, anti-corrosion and anti-collision performance of a main body 7 and reduce the weight of the main body 7. A plurality of grooves, recesses, clamping positions or similar structures may be formed at the peripheral wall of the main body 7 in advance for mounting of the spraying apparatus, the sewage recovery apparatus and the walking apparatus. Moreover, when the floor sweeping machine is used to clean a large place, the volume of the main body 7 can be increased to increase a volume of the fluid storage apparatus 8, so that the fluid storage apparatus 8 has sufficient cleaning liquid to meet cleaning requirements.

The walking apparatus includes a plurality of groups of rollers disposed at the lower part of the main body 7, the two rollers of each group are located at two opposite sides of the main body 7 respectively, and the main body 7 is driven to walk by the rollers for the cleaning operation.

The spraying apparatus includes a liquid outlet. The liquid outlet is in fluid communication with the fluid storage apparatus 8 for discharging the cleaning liquid. Optionally, the fluid storage apparatus 8 is communicated with the liquid outlet through a cleaning liquid output pipeline, and the cleaning liquid output pipeline is also provided with necessary components such as a pump, so that the cleaning liquid can be delivered to the liquid outlet punctually and in sufficient quantity. In other embodiments, the liquid outlet may also be disposed at the front side of a suction port. In this way, a surface to be cleaned at the front side of the suction port can be directly wetted by the liquid outlet, and the wetted surface to be cleaned is scrubbed by the cleaning apparatus, which also plays the role of scrubbing the surface to be cleaned. In some embodiments, the fluid storage apparatus 8 may be divided into a plurality of compartments, such as two compartments, one is used for storing the cleaning liquid and the other is used for storing recovered sewage. Further, in the case that clean water and a detergent are mixed, the compartment for storing the cleaning liquid may also be divided into two sub-compartments, and the volume of one sub-compartment is much greater than the volume of the other sub-compartment. In this way, the larger sub-compartment stores the clean water therein and the smaller sub-compartment stores the detergent.

The sewage recovery apparatus includes a fan assembly and a sewage recovery pipeline connected between the sewage recovery apparatus and the suction port. Under the action of a suction force provided by the fan assembly, impurities and sewage on the surface to be cleaned are sucked into the fluid storage apparatus 8 through the sewage recovery pipeline.

It should be noted that the cleaning device may also include other modules or assemblies that are not shown, or may only include some of the above modules or assemblies, which is not limited by the embodiments of the present disclosure, and only the above ground sweeping robot is taken as an example for illustration.

The cleaning apparatus in one embodiment of the present disclosure is explained in detail below. As shown in FIG. 5, the brush disc 1 includes a brush disc body 101 and bristles 102 disposed at the lower part of the brush disc body 101. After the brush disc body 101 is connected with a connector 302 of the transmission portion 3, the transmission portion 3 is driven to rotate in a first direction by rotation of the rotating motor so as to drive the bristles 102 of the brush disc 1 to rotate. Thus the ground to be cleaned is washed, and the sewage and dirt are thrown out by a centrifugal force generated by the rotation and recovered by the sewage recovery apparatus. The bristles 102 may be made of a nylon material, which can greatly enhance the corrosion resistance and aging resistance of the bristles 102, reduce the wear of the bristles 102, and thus prolong the service life of the bristles 102. The bristles 102 may also be injection-molded from an ABS material through an injection molding process, which has good corrosion resistance, good impact resistance and high stability. Further, the bristles 102 may also be disposed in waves along the length direction per se and only disposed at the outer edge of the brush disc 1, and two adjacent bristles 102 are staggered relative to each other, so that the density of the bristles 102 is increased, and a good water-retaining function can be achieved. In addition, the consumption of the bristles 102 can be reduced, and the good water-retaining function can be realized by only a single layer of bristles 102, thereby reducing a production cost of the brush disc 1.

The first direction is a rotating direction of the transmission portion 3 in a normal working state, that is to say, if the transmission portion 3 rotates clockwise during normal working, the first direction is the clockwise direction and the second direction is the counterclockwise direction; and if the transmission portion 3 rotates counterclockwise during normal working, the first direction is the counterclockwise direction and the second direction is the clockwise direction. When the brush disc 1 needs to be dismounted, a certain external force is applied to the brush disc 1, and then the transmission portion 3 is driven by the rotating motor to rotate relative to the brush disc 1 in the second direction, so that the brush disc 1 is disengaged from the transmission portion 3 through the engagement mechanism 2, thereby separating the brush disc 1 from the transmission portion 3 and completing the dismounting. When the brush disc 1 needs to be mounted, a certain external force is applied to the brush disc 1, and then the transmission portion 3 is driven by the rotating motor to rotate relative to the brush disc 1 in the first direction, so that the brush disc 1 is engaged with the transmission portion 3 through the engagement mechanism 2, thereby connecting the brush disc 1 with the transmission portion 3 to complete the mounting. Therefore, the automatic dismounting and mounting of the brush disc can be realized, and an operator does not need to squat down to approach the ground with his head to accurately align the brush disc with the transmission portion, which not only reduces the workload of the operator and is convenient for operation, but also improves the mounting and dismounting efficiency.

Further, the cleaning device also includes a lifting and lowering mechanism. The lifting and lowering mechanism is used for driving the transmission portion to lift or lower. The lifting and lowering mechanism 11 cooperates with the rotating motor 9 to realize the engagement or disengagement of the engagement mechanism 2 and the transmission portion 3.

The lifting and lowering mechanism 11 and the rotating motor 9 realize the lifting, lowering and rotating of the transmission portion, so that the automatic dismounting and mounting of the brush disc can be realized, which not only reduces the workload of the operator and is convenient for operation, but also improves the mounting and dismounting efficiency.

Figure 2:
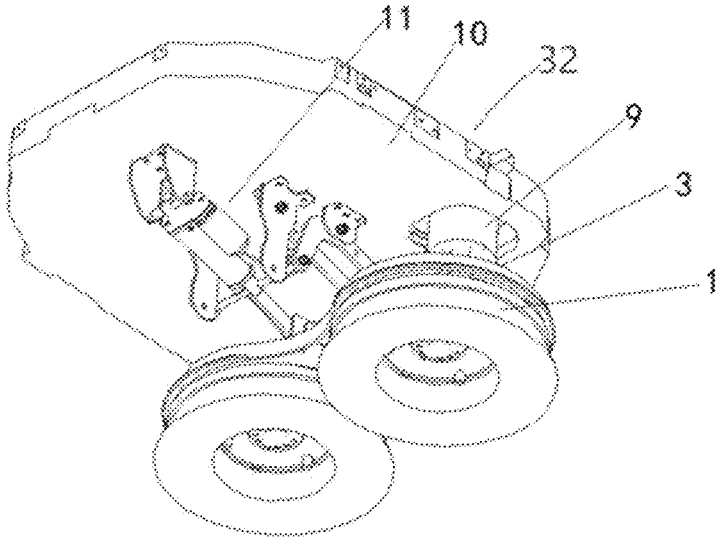
FIG. 2 is a structural diagram of a lifting and lowering mechanism and a cleaning apparatus which are connected as a whole.
Figure 3:
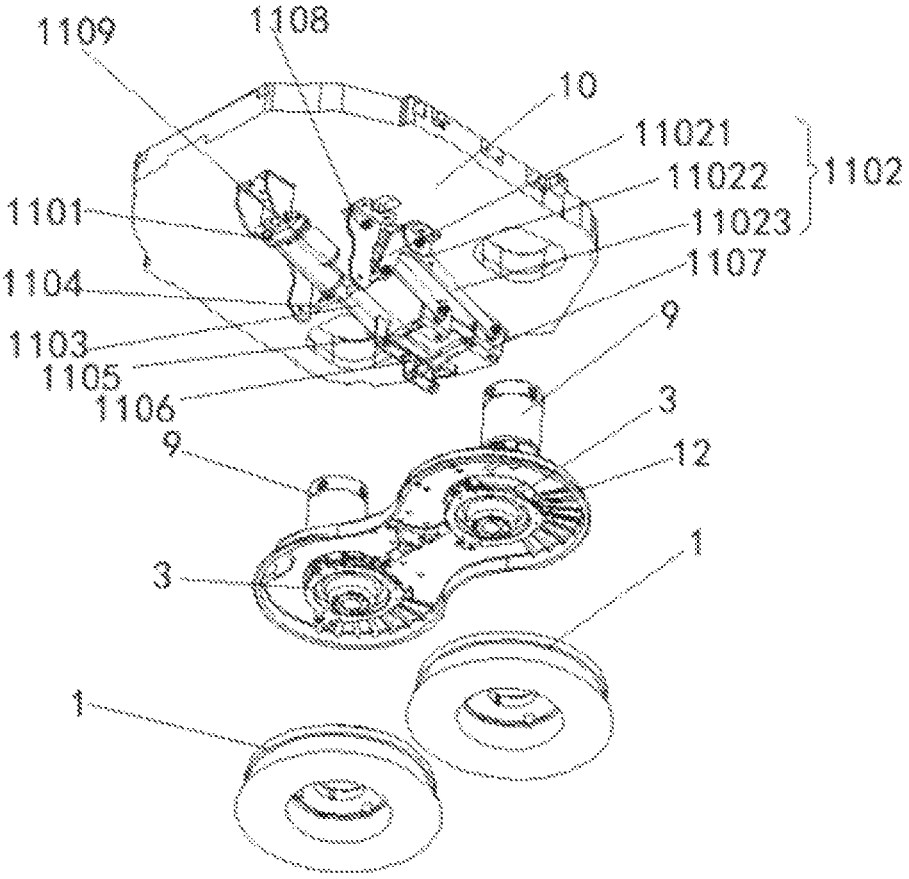
FIG. 3 is an exploded view of FIG. 2.

As shown in FIG. 2 and FIG. 3, the lifting and lowering mechanism 11 includes a synchronous linkage assembly, a driving motor 1101 and two connecting rod mechanisms. The bottom of the driving motor 1101 is rotationally connected with a chassis 10. The synchronous linkage assembly includes a first synchronizing shaft 1104, a second synchronizing shaft 1105, a third synchronizing shaft 1106 and a connector 1109, and the connector 1109 is rotationally connected with both the first synchronizing shaft 1104 and the second synchronizing shaft 1105. Each connecting rod mechanism includes a first connecting rod 1102 and a second connecting rod 1103. The first connecting rod 1102 includes a first swing arm 11021, a bent portion 11022 and a second swing arm 11023. The bent portion 11022 is respectively connected with one end of the first swing arm 11021 and one end of the second swing arm 11023, so that the first swing arm 11021 and the second swing arm 11023 form an included angle. The bent portion 11022 is rotationally connected with the chassis 10 of the main body, one end of the second connecting rod 1103 is rotationally connected with the chassis 10 and the second connecting rod 1103 and the second swing arm 11023 are disposed in parallel. The other ends of the first swing arms 11021 of the two connecting rod mechanisms are rotationally connected through the first synchronizing shaft 1104, the other ends of the second swing arms 11023 of the two connecting rod mechanisms are rotationally connected through the third synchronizing shaft 1106, the other ends of the second connecting rods 1103 of the two connecting rod mechanisms are rotationally connected through the second synchronizing shaft 1105, and the second synchronizing shaft 1105 and the third synchronizing shaft 1106 are parallel to each other and on the same horizontal plane. A driving end of the driving motor 1101 is rotationally connected with the first synchronizing shaft 1104. Moreover, a mounting base 1107 is disposed on the second synchronizing shaft 1105 and the third synchronizing shaft 1106, and the rotating motor 9 is connected with the mounting base 1107 through a packaging housing 12.

The driving motor 1101 drives the first synchronizing shaft 1104 to rotate, so as to drive the first swing arms 11021 to rotate around rotation joints of the bent portions 11022 and the chassis 10, and drive the second swing arms 11023 to rotate around rotation joints of the bent portions 11022 and the chassis 10 through the bent portions 11022. Then, through the linkage of the third synchronizing shaft 1106, the connector 1109 and the second synchronizing shaft 1105, the second connecting rods 1103 are driven to rotate synchronously with the first connecting rods 1102. With the rotation of the first connecting rods 1102 and the second connecting rods 1103, the rotating motor 9 can be driven to lift or lower, so that the transmission portion is driven to lift or lower by the rotating motor 9.

Further, the connecting rod mechanism also includes a position-limiting portion 1108 mounted on the chassis 10 of the main body, the position-limiting portion 1108 is located at a side of the first synchronizing shaft 1104 close to the driving motor 1101, and a limiting mechanism is used to block the rotation of the first connecting rod 1102 and the second connecting rod 1103 to limit a lowering height of the cleaning apparatus.

Specifically, the lifting and lowering mechanism 11 and the rotating motor 9 may realize engagement or disengagement of the brush disc and the transmission portion in two cooperation ways.

The first cooperation way is: in the process in which the lifting and lowering mechanism 11 drives the transmission portion 3 to lower, the rotating motor 9 drives the transmission portion 3 to rotate in the first direction, and after the lifting and lowering mechanism 11 drives the transmission portion 3 to lower in place, the rotating motor 9 drives the transmission portion 3 to rotate in the first direction relative to the brush disc 1 with a first maximum stroke, so that the engagement mechanism 2 is engaged with the transmission portion 3.

The first maximum stroke is a rotation stroke that the rotating motor 9 rotates in the first direction to engage the engagement mechanism 2 with the transmission portion 3, that is, if the rotation stroke is less than the first maximum stroke, the transmission portion 3 cannot be engaged with the engagement mechanism 2. Lowering in place means that the lifting and lowering mechanism lowers the transmission portion to a position where the bristles 102 of the brush disc 1 are engaged with the ground and the transmission portion apply a certain pressure to the brush disc 1.

Figure 7:
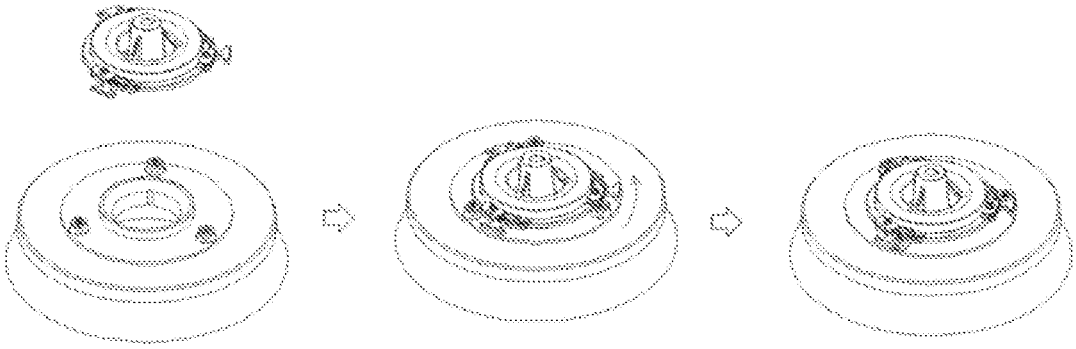
FIG. 7 is a schematic diagram of an engagement process of a brush disc and a transmission mechanism.
Figure 8:
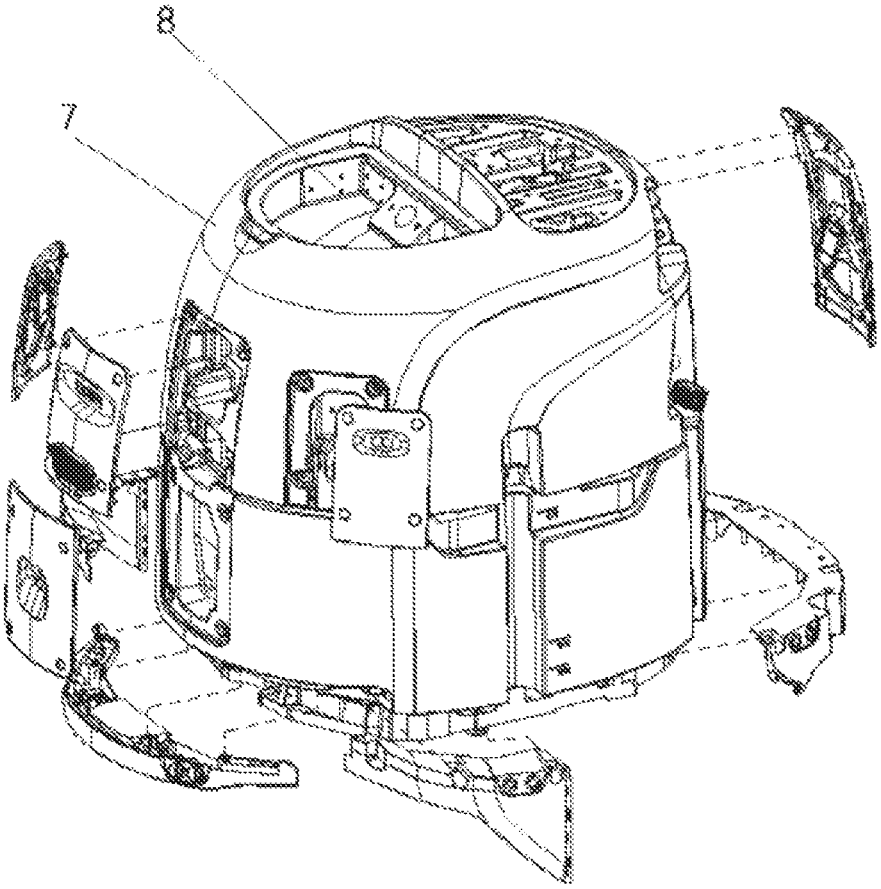
FIG. 8 is a structural diagram of a main body of a cleaning device according to an optional embodiment of the present disclosure.

As shown in FIG. 7, when the brush disc 1 is mounted, the brush disc 1 is placed on the ground, then the transmission portion 3 is lowered by the lifting and lowering mechanism, and in the lowering process, the rotating motor drives the transmission portion 3 to rotate in the first direction. After the lifting and lowering mechanism 11 drives the transmission portion 3 to lower in place, the transmission portion 3 is engaged with the brush disc 1 and applies the pressure to the brush disc 1. Similarly, the bristles 102 are also subjected to greater downward pressure applied by the lifting and lowering mechanism, so that a greater frictional force is generated between the bristles 102 and the ground. In this way, when the rotating motor 9 drives the transmission portion 3 to rotate in the first direction, the brush disc 1 will not easily rotate therewith, so that the transmission portion 3 can rotate relative to the brush disc 1, and the rotating motor drives the transmission portion 3 to rotate for the first maximum stroke. Therefore, the engagement mechanism 2 is engaged with the transmission portion 3, thereby completing mounting of the brush disc 3.

In the process in which the lifting and lowering mechanism 11 drives the transmission portion 3 to lower, the rotating motor 9 drives the transmission portion 3 to rotate in the second direction, and after the lifting and lowering mechanism 11 drives the transmission portion to lower in place, the rotating motor 9 drives the transmission portion 3 to rotate in the second direction relative to the brush disc 1 with a second maximum stroke, so as to disengage the engagement mechanism 2 from the transmission portion 3.

The second maximum stroke is a rotation stroke that the rotating motor 9 rotates in the second direction to disengage the engagement mechanism 2 from the transmission portion 3, that is, if the rotation stroke it is less than the second maximum stroke, the transmission portion 3 cannot be disengaged from the engagement mechanism 2.

Figure 6:
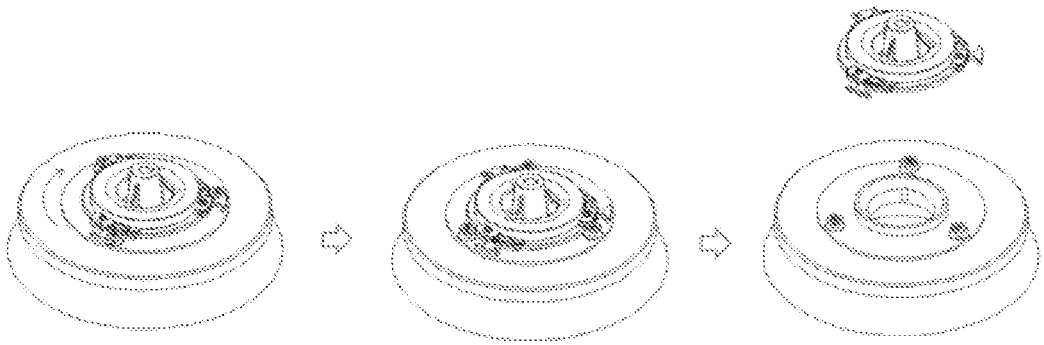
FIG. 6 is a schematic diagram of a disengagement process of a brush disc and a transmission mechanism.

As shown in FIG. 6, when the brush disc 1 needs to be dismounted, the transmission portion 3 is lowered by the lifting and lowering mechanism 11, and in the lowering process, the rotating motor 9 rotates in the second direction. After the lifting and lowering mechanism 11 drives the transmission portion 3 to lower in place, the transmission portion 3 is engaged with the brush disc 1 and applies a pressure to the brush disc 1. Similarly, the bristles 102 are also subjected to a greater downward pressure applied by the lifting and lowering mechanism, so that a greater frictional force is generated between the bristles 102 and the ground. In this way, when the rotating motor drives the transmission portion 3 to rotate in the second direction, the brush disc 1 will not easily rotate therewith, so that the transmission portion 3 can rotate relative to the brush disc 1, and the rotating motor drives the transmission portion 3 to rotate for the second maximum stroke. Therefore, the engagement mechanism 2 is disengaged from the transmission portion 3, thereby completing dismounting of the brush disc 1.

The second cooperation way is: after the lifting and lowering mechanism 11 drives the transmission portion 3 to lower in place, the rotating motor 9 drives the transmission portion 3 to rotate in the second direction relative to the brush disc with the second maximum stroke, so as to disengage the engagement mechanism 2 from the transmission portion 3.

As shown in FIG. 7, when the brush disc 1 needs to be mounted, the brush disc 1 is placed on the ground. After the lifting and lowering mechanism drives the transmission portion 3 to lower in place, the transmission portion 3 is engaged with the brush disc 1 and applies a pressure to the brush disc 1. Similarly, the bristles 102 are also subjected to a greater downward pressure applied by the lifting and lowering mechanism, so that a greater frictional force is generated between the bristles 102 and the ground. In this way, when the rotating motor drives the transmission portion 3 to rotate in the first direction, the brush disc 1 will not easily rotate therewith. Therefore, the transmission portion 3 can rotate relative to the brush disc 1, and the rotating motor drives the transmission portion 3 to rotate for the first maximum stroke, thereby engaging the engagement mechanism 2 with the transmission portion 3, and completing mounting of the brush disc 1.

The second cooperation way is: after the lifting and lowering mechanism 11 drives the transmission portion 3 to lower in place, the rotating motor 9 drives the transmission portion 3 to rotate in the first direction relative to the brush disc 1 with the first maximum stroke, so that the engagement mechanism 2 is engaged with the transmission portion 3.

Optionally, after the lifting and lowering mechanism 11 drives the transmission portion 3 to lower in place, the rotating motor 9 can rotate in the second direction at first to solve the problem that an engagement portion 201 and a position-limiting portion 202 overlap in the lowering process of the transmission portion 3. After the rotating motor 9 rotates at certain speed in the second direction at first and then rotates in the direction opposite to the first direction, a greater relative speed can be obtained between the engagement portion 201 and the position-limiting portion 202. In this case, the transmission portion 3 is driven to rotate in the first direction relative to the brush disc 1 with the first maximum stroke, so that the engagement mechanism 2 is more easily engaged with the transmission portion 3.

As shown in FIG. 6, when the brush disc 1 needs to be dismounted, after the lifting and lowering mechanism drives the transmission portion 3 to lower in place, the transmission portion 3 is engaged with the brush disc 1 and applies a pressure to the brush disc 1. Similarly, the bristles 102 are subjected to a greater downward pressure applied by the lifting and lowering mechanism, so that a greater frictional force is generated between the bristles 102 and the ground. In this way, when the rotating motor drives the transmission portion 3 to rotate in the second direction, the brush disc 1 will not easily rotate therewith. Therefore, the transmission portion 3 can rotate relative to the brush disc 1, and the rotating motor drives the transmission portion 3 to rotate for the second maximum stroke, so that the engagement mechanism 2 is disengaged from the transmission portion 3, thereby completing dismounting of the brush disc 1. Compared with the first cooperation way, this way can reduce power consumption of the rotating motor and save energy since the rotating motor works after the transmission portion is lowered in place.

In the above embodiment, as shown in FIG. 1 and FIG. 4, the engagement mechanism 2 includes at least two engagement portions 201 disposed on the transmission portion 3, and position-limiting portions 202 disposed on the brush disc 1 and corresponding to the engagement portions 201 respectively. After the brush disc 1 is engaged with the transmission portion 3, when the transmission portion 3 drives the engagement portions 201 to rotate to engagement positions, each engagement portion 201 is engaged with the corresponding position-limiting portion 202. When the transmission portion 3 drives the engagement portions 201 to rotate to disengagement positions, each engagement portion 201 is disengaged from the corresponding position-limiting portion 202.

The number of the engagement portions 201 may be set by an operator according to actual demands, which is not strictly limited by the present embodiment. In some possible implementations, the number of the engagement portions 201 is three, which can not only ensure that the number of the engagement portions 201 is less and reduce complexity of the overall structure, but also ensure the stability of engagement. Since there is a one-to-one correspondence relationship between the position-limiting portions 202 and the engagement portions 201, the number of the position-limiting portions 202 is the same as that of the engagement portions 201.

In the embodiment of the present disclosure, the engagement portion 201 has the ability to be engaged with the position-limiting portion 202, but whether the engagement portion 201 can be engaged with the position-limiting portion 202 depends on whether the engagement portion 201 reaches the engagement position.

The disengagement position is specifically any position between two adjacent spaced position-limiting portions 202. When the transmission portion 3 drives the engagement portion 201 to rotate to any position between the two adjacent spaced position-limiting portions 202, the engagement portion 201 is disengaged from the position-limiting portion 202, that is, the engagement is released.

In specific applications, as shown in FIG. 1 and FIG. 4, at least two engagement portions 201 are connected with the outer edge of the connector 302 of the transmission portion 3, and the at least two engagement portions 201 are evenly distributed on the same circumference. At least two position-limiting portions 202 are disposed on the upper surface of the brush disc 1 and evenly distributed on the same circumference, so as to ensure that the brush disc 1 is subjected to a uniform connection force after the engagement portions 201 and the position-limiting portions 202 are engaged, and prevent the brush disc 1 from inclining and thus affecting the cleaning effect.

Further, the first direction is the same as a rotating direction of the transmission portion 3 in the normal working state.

During the cleaning operation of the floor washing machine, the lifting and lowering mechanism drives the brush disc 1 to lower through the transmission portion 3, so that the brush disc 1 is in contact with the surface to be cleaned. Then the cleaning liquid is delivered to the liquid outlet to be provided for the brush disc 1, and at the same time, the rotating motor drives the brush disc 1 to rotate through the transmission portion 3, thereby realizing the cleaning operation. After the cleaning operation is finished, the lifting and lowering mechanism drives the brush disc 1 to lift through the transmission portion 3, so that the cleaning apparatus moves away from the surface to be cleaned by a certain distance, thereby reducing the wear of the ground to the cleaning apparatus and prolonging the service life of the cleaning apparatus.

In specific use, as shown in FIG. 2 and FIG. 3, the number of the cleaning apparatuses may be two, and rotating directions of the transmission portions of the two cleaning apparatuses are opposite in the normal working state.

When the two cleaning apparatuses work, the rotating directions of the transmission portions 3 of the two cleaning apparatuses are opposite in the normal working state, that is to say, the first directions of the two cleaning apparatuses are opposite, and the second directions thereof are also opposite, so that impurities such as dust can be swept to the suction port in the middle of the cleaning device for absorption. Exemplarily, if the transmission portion 3 of one cleaning apparatus rotates clockwise in the normal working state, that is, the first direction is the clockwise direction and the second direction is the counterclockwise direction, the transmission portion 3 of the other cleaning apparatus rotates counterclockwise in the normal working state, that is, the first direction is the counterclockwise direction and the second direction is the clockwise direction.

In the embodiment of the present disclosure, after the brush disc 1 is engaged with the transmission portion 3, all the engagement portions 201 and all the position-limiting portions 202 are located on the same circumference, thereby ensuring that when one engagement portion 201 is engaged with the corresponding position-limiting portion 202, other engagement portions 201 are also engaged with the corresponding position-limiting portions 202, and improving the accuracy of engagement.

In the above embodiment, as shown in FIG. 1, FIG. 4 and FIG. 5, each engagement portion 201 includes an engagement body 2011, and the engagement body 2011 is connected with the outer edge of the transmission portion 3 and extends in a direction away from the transmission portion 3. The engagement body 2011 is provided with a clamping groove 2012 at least in a side opposite to the corresponding position-limiting portion 202, and each position-limiting portion 202 includes a position-limiting pin 2021 connected with the brush disc 1. When the transmission portion 3 drives the engagement bodies 2011 to rotate to the engagement positions, the clamping groove 2012 of each engagement body 2011 is engaged with the corresponding position-limiting pin 2021. When the transmission portion 3 drives the engagement bodies 2011 to rotate to the disengagement positions, the clamping groove 2012 of each engagement body 2011 is disengaged from the corresponding position-limiting pin 2021.

Specifically, the position-limiting pin 2021 includes a position-limiting post and a position-limiting protrusion disposed above the position-limiting post. When the engagement body 2011 rotates to the engagement position, the position-limiting post is at least partially located in the clamping groove 2012, and the position-limiting protrusion plays a role of axially limiting the edge of the clamping groove 2012 to prevent the engagement body 2011 from falling off due to gravity in the axial direction, thereby realizing the engagement between the clamping groove 2012 and the position-limiting pin 2021. When the engagement body 2011 rotates to the disengagement position, the position-limiting post is separated from the clamping groove 2012, and the position-limiting protrusion will not play the role of axial limiting, so that the engagement portion 201 can be separated from the position-limiting portion 202. As the engagement and disengagement can be realized through the cooperation between the clamping groove 2012 and the position-limiting pin 2021, the structure is simple and the operation is convenient.

Further, as shown in FIG. 5, the position-limiting pin 2021 is detachably connected with the brush disc body 101, the main body is provided with a passage for fasteners 2022, such as bolts, therein, and the fasteners 2022, such as the bolts, pass through the passage to be in threaded connection with the brush disc 1, thereby realizing detachable connection between the position-limiting pin 2021 and the brush disc 1. In case of serious wear of the position-limiting pin 2021, it is only necessary to replace the position-limiting pin 2021 without scrapping the whole brush disc 1, so as to prolong the service life of the brush disc 1 and reduce the cost.

The clamping groove may be disposed in the engagement body 2011 in different ways, which will be described in detail below.

The first implementation is that the engagement body 2011 is provided with the clamping groove 2012 only in a side opposite to the corresponding position-limiting portion 202.

In this implementation, only the side opposite to the corresponding position-limiting portion 202 is provided with the clamping groove 2012, which can simplify the manufacturing process and flow of the engagement portion 201 and improve the production efficiency. In order to improve the stability of engagement, the rotating direction of the clamping groove 2012 of the engagement body 2011 towards the corresponding position-limiting pin 2021 should be the same as the rotating direction of the transmission portion 3 in the normal working state.

As shown in FIG. 1 and FIG. 4, the second implementation is that each engagement body 2011 is provided with a first clamping groove 2013 in a first side and a second clamping groove 2014 in a second side, and the second side is a side of the engagement body 2011 opposite to the first side. The engagement positions include a first engagement position and a second engagement position. When the transmission portion 3 drives the engagement bodies 2011 to rotate to the first engagement positions, the first clamping groove 2013 of each engagement body 2011 is engaged with the adjacent position-limiting pin 2021. When the transmission portion 3 drives the engagement bodies 2011 to rotate to the second engagement positions, the second clamping groove 2014 of each engagement body 2011 is engaged with the corresponding position-limiting pin 2021. When the transmission portion 3 drives the engagement bodies 2011 to rotate to the disengagement positions, the first clamping groove 2013 of each engagement body 2011 is disengaged from the adjacent position-limiting pin 2021, and the second clamping groove 2014 of each engagement body 2011 is disengaged from the adjacent position-limiting pin 2021.

In this implementation, the first clamping groove 2013 and the second clamping groove 2014 are disposed in two opposite sides of the engagement body 2011 respectively, so that the engagement body 2011 can be engaged with two position-limiting pins 2021 adjacent thereto, that is, the engagement body 2011 can rotate clockwise or counterclockwise to realize engagement. That is, according to the rotating direction of the transmission portion 3 in the normal working state, one of the two position-limiting pins 2021 adjacent to the engagement body 2011 can be selected as the position-limiting portion 202 corresponding to the engagement portion 201. If the rotating direction of the transmission portion 3 in the normal working state is the clockwise direction and the direction in which the engagement body 2011 rotates to the first engagement position is the clockwise direction, the position-limiting pin 2021 adjacent to the first clamping groove 2013 is determined as the position-limiting portion 202 corresponding to the engagement portion 201. Similarly, if the rotating direction of the transmission portion 3 in the normal working state is the counterclockwise direction and the direction in which the engagement body 2011 rotates to the second engagement position is the counterclockwise direction, the position-limiting pin adjacent to the second clamping groove 2014 is determined as the position-limiting portion 202 corresponding to the engagement portion 201, so that the engagement portion 201 can be engaged with the corresponding position-limiting portion 202 regardless of whether the rotating direction of the transmission portion 3 in the normal working state is the clockwise or counterclockwise direction, thereby improving applicability and flexibility in use. However, the disengagement position is still any position between two adjacent spaced position-limiting portions 202, so that when the engagement body 2011 rotates to the disengagement position, both the first clamping groove 2013 and the second clamping groove 2014 are disengaged from the adjacent position-limiting portions, thereby facilitating the disengagement operation.

Further, with respect to the second implementation, as shown in FIG. 1 and FIG. 4, at least one engagement portion 201 is provided with a corresponding stop portion 4, and the stop portion 4 is used to stop the first clamping groove 2013 or the second clamping groove 2014 from being engaged with the adjacent position-limiting portion 202.

When an angle by which the engagement portion 201 rotates towards the disengagement position is too large, the stop portion 4 can avoid the situation that the brush disc 1 cannot be separated from the transmission portion 3 since the first clamping groove 2013 or the second clamping groove 2014 in the other side is engaged with the adjacent position-limiting portion 202. Specifically, when the rotating direction of the first clamping groove 2013 towards the adjacent position-limiting portion 202 is the same as the rotating direction of the transmission portion 3 in the normal working state, the stop portion 4 is disposed on at least one second clamping groove 2014, so that the second clamping groove 2014 is prevented from being engaged with the adjacent position-limiting portion 202 in the disengagement process. Similarly, when the rotating direction of the second clamping groove 2014 towards the adjacent position-limiting portion 202 is the same as the rotating direction of the transmission portion 3 in the normal working state, the stop portion 4 is disposed on at least one first clamping groove 2013, so that the first clamping groove 2013 is prevented from being engaged with the adjacent position-limiting portion 202 in the disengagement process.

In a specific application process, all the engagement portions 201 and all the position-limiting portions 202 are engaged or disengaged at the same time, so that all the first clamping grooves 2013 or second clamping grooves 2014 can be stopped by disposing the corresponding stop portion 4 on one or several engagement portions 201, thereby simplifying the structure and facilitating the assembly and manufacture. Of course, each engagement portion 201 may also be provided with the stop portion 4, so that a resistance of the stop portion 4 can be improved and a stopping effect can be improved.

Further, the stop portion 4 is mounted at a position on the edge of the transmission portion 3 corresponding to the first clamping groove 2013 or the second clamping groove 2014, and the first clamping groove 2013 or the second clamping groove 2014 is at least partially shielded by the stop portion 4.

The stop portion 4 shields the first clamping groove 2013 or the second clamping groove 2014, which can reduce an occupied space of the stop portion 4, so that the structure is more compact.

Specifically, the stop portion 4 is detachably connected with the edge of the transmission portion 3.

The stop portion 4 and the transmission portion 3 are detachably connected, and the specific detachable connection may be realized by an existing connection way such as bolts 6, which is not strictly limited by the present embodiment. The detachable connection facilitates the mounting and dismounting of the stop portion 4 to facilitate the adjustment of the position of the stop portion 4. For example, if the first stop portion 4 is configured at the first clamping groove 2013, and the direction in which the first clamping groove 2013 rotates to the adjacent position-limiting portion 202 is opposite to the rotating direction of the transmission portion 3 in the normal working state, the first stop portion 4 can be detached and mounted at the second clamping groove 2014, which is convenient for operation by a user.

In the above embodiment, at least one engagement portion 201 is provided with a corresponding locking portion 5, and the locking portion 5 is used for locking with the corresponding position-limiting portion 202 when each engagement portion 201 is engaged with the corresponding position-limiting portion 202, so as to restrict the engagement portion 201 from rotating towards the disengagement position.

By locking of the locking portion 5, the phenomenon that the engagement is loose or even the disengagement occurs due to the rotation of the engagement portion towards the disengagement position since the cleaning device is shaken in the traveling process can be prevented, and the stability and reliability of the engagement are further improved.

In the specific application process, all the engagement portions 201 and all the position-limiting portions 202 are engaged or disengaged at the same time, so that all the engagement portions can be locked by disposing the corresponding locking portion 5 on one or several engagement portions 201, thereby simplifying the structure and facilitating the assembly and manufacture. Of course, each engagement portion 201 may be provided with the locking portion 5, so that a locking force can be improved to improve a locking effect.

Specifically, as shown in FIG. 1 and FIG. 4, the locking portion 5 is mounted at a position on the edge of the transmission portion 3 corresponding to the engagement portion 201, and the bolts 6 fix a clip-shaped curved portion of the locking portion 5 and the stop portion 4 together at one side of the engagement portion. The locking portion 5 includes an elastic arm 501, and an end of the elastic arm 501 close to the corresponding position-limiting portion 202 is provided with a curved portion 502. It needs to perform repeated experiments and calculations to determine the bending degree of the curved portion 502, so that not only is the engagement between the engagement portion and the position-limiting portion not hindered, but also easy unhooking after the engagement is avoided. For the bending degree, it is preferable that an obtuse angle is formed at the joint of 501 and 502, and is further preferably 120-150 degrees, and the bending angle of 502 is further preferably 80-120 degrees. When each engagement portion 201 is engaged with the corresponding position-limiting portion 202, the position-limiting portion 202 is at least partially located in the curved portion 502 to restrict the engagement portion 201 from rotating towards the disengagement position.

In the process of mounting and dismounting the brush disc 1, the lifting and lowering mechanism applies a greater downward pressure, so that a greater frictional force is generated between the bristles 102 and the ground, and is greater than an interaction force between the curved portion 502 and the position-limiting portion 202. In the process in which the transmission portion 3 rotates in the first direction relative to the brush disc 1, the end of the elastic arm 501 provided with the curved portion 502 gradually approaches the corresponding position-limiting portion 202. After the curved portion 502 abuts against the position-limiting portion 202, the elastic arm 501 moves towards a direction close to the transmission portion 3 after the curved portion 502 is stressed, so that the curved portion 502 avoids the transmission portion 3 and the transmission portion 3 rotates continuously. Then, the curved portion 502 moves towards a direction away from the transmission portion 3 by a resilient force generated by deformation of the elastic arm 501, so that the position-limiting portion 202 is at least partially located in the curved portion 502, and then automatic hooking between the curved portion 502 and the position-limiting portion 202 is realized.

Figure 9:
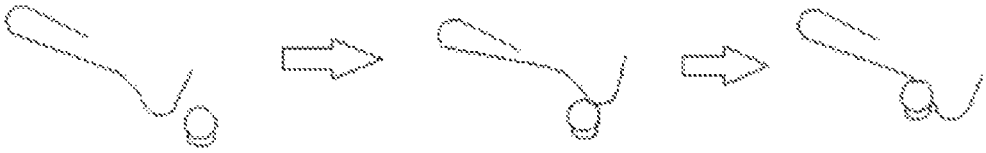
FIG. 9 is a schematic diagram of a hooking process of a curved portion and a position-limiting portion.
Figure 10:
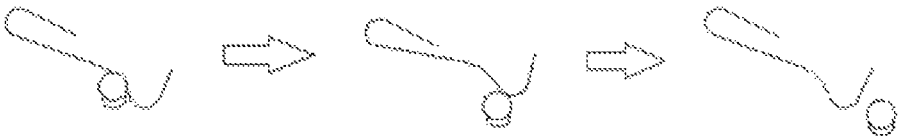
FIG. 10 is a schematic diagram of an unhooking process of a curved portion and a position-limiting portion.

In specific applications, regarding the case that the engagement body 2011 is only provided with the clamping groove 2012 in the side opposite to the corresponding position-limiting portion 202, the curved portion 502 is at least partially located above the clamping groove 2012, and the other end of the elastic engagement portion may be fixed to a connection portion of the transmission portion 3. In this way, as shown in FIG. 9, in the process in which the transmission portion 3 rotates in the first direction relative to the brush disc 1, the end of the elastic arm 501 provided with the curved portion 502 gradually approaches the corresponding position-limiting portion 202. After the curved portion 502 abuts against the position-limiting portion 202, the elastic arm 501 moves towards the direction close to the transmission portion 3 after the curved portion 502 is stressed, so that the curved portion 502 avoids the transmission portion 3 and the transmission portion 3 rotates continuously. Then, the curved portion 502 moves towards the direction away from the transmission portion 3 by a resilient force generated by deformation of the elastic arm 501, so that the position-limiting portion 202 is at least partially located in the curved portion 502, and further automatic hooking between the curved portion 502 and the position-limiting portion 202 is realized. Similarly, as shown in FIG. 10, in a process in which the transmission portion 3 rotates in the first direction relative to the brush disc 1, after the curved portion 502 abuts against the position-limiting portion 202, the elastic arm 501 moves towards the direction close to the transmission portion 3 after the curved portion 502 is stressed, so that the curved portion 502 avoids the position-limiting portion 202, and the position-limiting portion 202 is disengaged from the curved portion 502. Then with the rotation of the transmission portion 3 in the second direction relative to the brush disc 1, the curved portion 502 moves towards the direction away from the transmission portion due to the resilient force generated by deformation of the elastic arm 501, which completes the separation between the position-limiting portion 202 and the curved portion 502, thereby releasing the hooking between the curved portion 502 and the position-limiting portion 202.

As shown in FIG. 1 and FIG. 2, in the case that each engagement body 2011 is provided with the first clamping groove 2013 in the first side and the second clamping groove 2014 in the second side, if it is necessary to rotate the first clamping groove 2013 to be engaged with the adjacent position-limiting pin, the curved portion 502 is at least partially located above the first clamping groove 2013, and if it is necessary to rotate the second clamping groove 2014 to be engaged with the adjacent position-limiting pin, the curved portion 502 is at least partially located above the second clamping groove 2014, and the rest hooking and unhooking principles may refer to the above descriptions, and will not repeated here.

In some possible implementations, as shown in FIG. 1 and FIG. 5, the lower part of the transmission portion 3 is provided with a guiding portion 303, the brush disc 1 is also provided with an orientating portion 103 adapted to the guiding portion 303, and the transmission portion 3 is engaged with the brush disc 1 through cooperation between the guiding portion 303 and the orientating portion 103.

Through the cooperation between the orientating portion 103 and the guiding portion 303, the engagement between the brush disc 1 and the transmission portion 3 can be realized quickly and accurately, so as to avoid the adjustment of relative positions between the orientating portion 103 and the brush disc 1, thereby improving the dismounting and mounting efficiency.

Specifically, as shown in FIG. 1 and FIG. 5, the guiding portion 303 is a protrusion extending downward from the transmission portion 3, and the orientating portion 103 is a recess for accommodating the protrusion.

The engagement between the brush disc 1 and the transmission portion 3 can be realized by extending the protrusion into the recess, and the separation between the brush disc 1 and the transmission portion 3 can be realized by taking the protrusion out of the recess. Thus, not only is the engagement operation convenient, but also the structure is simple and the manufacture is convenient.

Optionally, the width of the guiding portion 303 is not less than a distance between the brush disc and a soft enclosure outside the brush disc. Therefore, when mounting the brush disc, the user only needs to put the brush disc in the soft enclosure without accurately aligning the brush disc with the transmission portion, which greatly reduces the mounting difficulty of the brush disc and improves the work efficiency of an operator.

The embodiments of the present disclosure provide a cleaning device, which includes a control apparatus for controlling a rotating motor to rotate and a lifting and lowering motor to lift or lower, and at least one cleaning apparatus, which includes a brush disc, an engagement mechanism and a transmission portion connected with the rotating motor. The lifting and lowering motor lowers the cleaning apparatus, and the rotating motor drives the transmission portion to rotate, so that the engagement mechanism is engaged with the transmission portion to realize mounting of the brush disc.

Optionally, the rotating motor drives the transmission portion to rotate in a first direction relative to the brush disc, so that the engagement mechanism is engaged with the transmission portion.

Optionally, the lifting and lowering motor lowers the cleaning apparatus, and then the rotating motor drives the transmission portion to rotate, so that the engagement mechanism is disengaged from the transmission portion to realize dismounting of the brush disc.

Optionally, the rotating motor drives the transmission portion to rotate in a second direction opposite to the first direction relative to the brush disc, so as to disengage the engagement mechanism from the transmission portion.

Optionally, the first direction is a rotating direction of the transmission portion in a normal working state.

Optionally, a position-limiting portion includes a position-limiting pin connected with a brush disc body.

Optionally, the brush disc body is of a disc-shaped structure, the number of the position-limiting portions is at least two, and the position-limiting portions are evenly distributed on an outer circumference of the disc-shaped structure.

The embodiments of the present disclosure provide a cleaning system, including the cleaning device according to the above embodiment.

The present disclosure provides a cleaning device including at least one cleaning apparatus. The cleaning apparatus includes a brush disc, an engagement mechanism and a transmission portion connected with a rotating motor. The lower part of the transmission portion is provided with a guiding portion, the brush disc is provided with an orientating portion adapted to the guiding portion, and the transmission portion is combined with the brush disc through the cooperation of the guiding portion and the orientating portion.

Optionally, that cleaning device further includes a control apparatus for controlling the rotating motor to rotate and controlling a lifting and lowering motor to lift or lower. The lifting and lowering motor lowers the cleaning apparatus, and the rotating motor drives the transmission portion to rotate, so that the engagement mechanism is engaged with the transmission portion to realize the mounting of the brush disc.

Optionally, the rotating motor drives the transmission portion to rotate in a first direction relative to the brush disc, so that the engagement mechanism is engaged with the transmission portion.

Optionally, the lifting and lowering motor lowers the cleaning apparatus, and then the rotating motor drives the transmission portion to rotate, so that the engagement mechanism is disengaged from the transmission portion to realize the dismounting of the brush disc.

Optionally, the rotating motor drives the transmission portion to rotate in a second direction opposite to the first direction relative to the brush disc, so as to disengage the engagement mechanism from the transmission portion.

Optionally, the first direction is a rotating direction of the transmission portion in a normal working state.

The embodiments of the present disclosure provide a cleaning system, including the cleaning device according to the above embodiment.

The embodiments of the present disclosure provide a mounting method for a cleaning apparatus of a cleaning device, which includes:

step S101: a rotating motor is controlled to drive a transmission portion 3 to rotate in a first direction relative to a brush disc 1, so that an engagement mechanism 2 is engaged with the transmission portion 3.

In one implementation, before step S101, the method may further include:

step S201*a*: a lifting and lowering mechanism is controlled to drive the transmission portion 3 to lower, and the rotating motor is controlled to drive the transmission portion 3 to rotate in the first direction in a process in which the lifting and lowering mechanism drives the transmission portion 3 to lower.

In this implementation, step S101 may include the following step:

step S1011*a*: after the lifting and lowering mechanism drives the transmission portion 3 to lower in place, the rotating motor is controlled to drive the transmission portion 3 to rotate in the first direction relative to the brush disc 1 with a first maximum stroke, so that the engagement mechanism 2 is engaged with the transmission portion 3.

In another implementation, before step S101, the method may further include:

step S201*b*: the lifting and lowering mechanism is controlled to drive the transmission portion 3 to lower.

In this implementation, step S101 may include the following step:

step S1011*b*: after the lifting and lowering mechanism drives the transmission portion 3 to lower in place, the rotating motor is controlled to drive the transmission portion 3 to rotate in the first direction relative to the brush disc 1 with the first maximum stroke, so that the engagement mechanism 2 is engaged with the transmission portion 3.

The embodiments of the disclosure provide a dismounting method for a cleaning apparatus of a cleaning device, which includes:

step S301: a rotating motor is controlled to drive a transmission portion 3 to rotate in a second direction relative to a brush disc 1, so as to disengage an engagement mechanism 2 from the transmission portion 3.

In one implementation, specifically, before step S301, the method may further include:

step S401*a*: a lifting and lowering mechanism is controlled to drive the transmission portion 3 to lower, and the rotating motor is controlled to drive the transmission portion 3 to rotate in the second direction in a process in which the lifting and lowering mechanism drives the transmission portion 3 to lower.

In this implementation, step S301 may include the following step:

step S3011*a*: after the lifting and lowering mechanism drives the transmission portion 3 to lower in place, the rotating motor is controlled to drive the transmission portion 3 to rotate in the second direction relative to the brush disc 1 with a second maximum stroke, so as to disengage the engagement mechanism 2 from the transmission portion 3.

In another implementation, before step S301, the method may further include:

step S401*b*: the lifting and lowering mechanism is controlled to drive the transmission portion 3 to lower.

In this implementation, step S301 may include the following step:

step S3011*b*: after the lifting and lowering mechanism drives the transmission portion 3 to lower in place, the rotating motor is controlled to drive the transmission portion 3 to rotate in the second direction relative to the brush disc 1 with the second maximum stroke, so as to disengage the engagement mechanism 2 from the transmission portion 3.

The technical solutions involved in the present disclosure have been explained by the above embodiments, but it should be understood that the above embodiments are only used for the purposes of illustration and description, and are not intended to limit the present disclosure within the scope of the described embodiments. In addition, it can be understood by those skilled in the art that the present disclosure is not limited to the above embodiments, and more variations and modifications can be made according to the teaching of the present disclosure, and these variations and modifications all fall within the claimed scope of the present disclosure. The protection scope of the present disclosure is defined by the appended claims and their equivalent scopes.

What is claimed is:

1. A cleaning device, comprising:

a controller configured to control a rotating motor to rotate; and at least one cleaning apparatus, comprising a brush disc, an engagement mechanism and a transmission portion connected with the rotating motor, wherein the rotating motor drives the transmission portion to rotate in a first direction relative to the brush disc, such that the brush disc is engaged with the transmission portion through the engagement mechanism; the rotating motor drives the transmission portion to rotate in a second direction opposite to the first direction relative to the brush disc, such that the engagement mechanism is disengaged from the transmission portion; and the first direction is a rotating direction of the transmission portion in a normal working state, the second direction is a rotating direction of the rotating motor during a disengagement process.

2. The cleaning device according to claim 1, wherein the cleaning device further comprises a lifting and lowering mechanism, wherein the lifting and lowering mechanism is used for driving the transmission portion to lift or lower; and the lifting and lowering mechanism and the rotating motor cooperate with each other to realize engagement or disengagement of the engagement mechanism and the transmission portion.

3. The cleaning device according to claim 2, wherein the rotating motor drives the transmission portion to rotate in the first direction in a process of the lifting and lowering mechanism driving the transmission portion to lower, and after the lifting and lowering mechanism drives the transmission portion to lower in place, the rotating motor drives the transmission portion to rotate in the first direction relative to the brush disc with a first maximum stroke, such that the engagement mechanism is engaged with the transmission portion; the first maximum stroke is a rotation stroke that the rotating motor rotates in the first direction to engage the engagement mechanism with the transmission portion;

or after the lifting and lowering mechanism drives the transmission portion to lower in place, the rotating motor drives the transmission portion to rotate in the first direction relative to the brush disc with a first maximum stroke, such that the engagement mechanism is engaged with the transmission portion.

4. The cleaning device according to claim 2, wherein the rotating motor drives the transmission portion to rotate in the second direction in a process of the lifting and lowering mechanism driving the transmission portion to lower, and after the lifting and lowering mechanism drives the transmission portion to lower in place, the rotating motor drives the transmission portion to rotate in the second direction relative to the brush disc with a second maximum stroke, such that the engagement mechanism is disengaged from the transmission portion; the second maximum stroke is a rotation stroke that the rotating motor rotates in the second direction to disengage the engagement mechanism from the transmission portion;

or after the lifting and lowering mechanism drives the transmission portion to lower in place, the rotating motor drives the transmission portion to rotate in the second direction relative to the brush disc with a second maximum stroke, such that the engagement mechanism is disengaged from the transmission portion.

5. The cleaning device according to claim 2, wherein after the lifting and lowering mechanism drives the transmission portion to lower in place, the rotating motor drives the transmission portion to rotate in the first direction relative to the brush disc with a first maximum stroke, such that the engagement mechanism is engaged with the transmission portion.

6. The cleaning device according to claim 2, wherein after the lifting and lowering mechanism drives the transmission portion to lower in place, the rotating motor drives the transmission portion to rotate in the second direction relative to the brush disc with a second maximum stroke, such that the engagement mechanism is disengaged from the transmission portion.

7. The cleaning device according to claim 1, wherein the number of the cleaning apparatus is two, and the rotating directions of the transmission portions of the two cleaning apparatuses are opposite in a normal working state.

8. The cleaning device according to claim 7, wherein the at least one engagement portion is provided with a corresponding locking portion, and the locking portion is used for locking with the corresponding position-limiting portion in response to determining that each engagement portion is engaged with the corresponding position-limiting portion, so as to restrict the engagement portion from rotating towards the disengagement position.

9. The cleaning device according to claim 8, wherein the locking portion is mounted at a position on the edge of the transmission portion corresponding to the engagement portion;

the locking portion comprises an elastic arm, and an end of the elastic arm close to the corresponding position-limiting portion is provided with a curved portion; and in response to determining that each engagement portion is engaged with the corresponding position-limiting portion, the position-limiting portion is at least partially located in the curved portion, so as to restrict the engagement portion from rotating towards the disengagement position.

10. The cleaning device according to claim 1, wherein the engagement mechanism comprises at least two engagement portions disposed on the transmission portion and position-limiting portions disposed on the brush disc and corresponding to the engagement portions respectively; and after the brush disc is engaged with the transmission portion, in response to determining that the transmission portion drives the engagement portions to rotate to engagement positions, each engagement portion is engaged with the corresponding position-limiting portion; and in response to determining that the transmission portion drives the engagement portions to rotate to disengagement positions, each engagement portion is disengaged from the corresponding position-limiting portion.

11. The cleaning device according to claim 10, wherein after the brush disc is engaged with the transmission portion, all the engagement portions and all the position-limiting portions are located on an identical circumference.

12. The cleaning device according to claim 10, wherein each engagement portion comprises an engagement body, and the engagement body is connected with an outer edge of the transmission portion and extends towards a direction away from the transmission portion; the engagement body is provided with a clamping groove at least at a side opposite to the corresponding position-limiting portion, and each position-limiting portion comprises a position-limiting pin connected with the brush disc; and in response to determining that the transmission portion drives the engagement bodies to rotate to the engagement positions, the clamping groove of each engagement body is engaged with the corresponding position-limiting pin; and in response to determining that the transmission portion drives the engagement bodies to rotate to the disengagement positions, the clamping groove of each engagement body is disengaged from the corresponding position-limiting pin.

13. The cleaning device according to claim 12, wherein each engagement body is provided with a first clamping groove at a first side and a second clamping groove at a second side, and the second side is a side of the engagement body opposite to the first side; the engagement positions comprise a first engagement position and a second engagement position;

in response to determining that the transmission portion drives the engagement bodies to rotate to the first engagement positions, the first clamping groove of each engagement body is engaged with the adjacent position-limiting pin; in response to determining that the transmission portion drives the engagement bodies to rotate to the second engagement position, the second clamping groove of each engagement body is engaged with the corresponding position-limiting pin; in response to determining that the transmission portion drives the engagement bodies to rotate to the disengagement positions, the first clamping groove of each engagement body is in contact and is engaged with the adjacent position-limiting pin, and the second clamping groove of each engagement body is in contact and is engaged with the adjacent position-limiting pin.

14. The cleaning device according to claim 13, wherein the at least one engagement portion is provided with a corresponding stop portion, and the stop portion is used for preventing the first clamping groove or the second clamping groove from being engaged with the adjacent position-limiting portion.

15. The cleaning device according to claim 14, wherein the stop portion is mounted at a position on the edge of the transmission portion corresponding to the first clamping groove or the second clamping groove, and the first clamping groove or the second clamping groove is at least partially shielded by the stop portion.

16. The cleaning device according to claim 15, wherein the stop portion is detachably connected with the edge of the transmission portion.

17. The cleaning device according to claim 1, wherein a guiding portion is disposed at the lower part of the transmission portion, an orientating portion adapted to the guiding portion is further disposed on the brush disc, and the transmission portion is engaged with the brush disc through cooperation of the guiding portion and the orientating portion.

18. The cleaning device according to claim 17, wherein the guiding portion is a protrusion extending downward from the transmission portion, and the orientating portion is a recess for accommodating the protrusion.

19. The cleaning device according to claim 1, wherein the cleaning device is a self-moving cleaning device.

* * * * *